United States Patent [19]

Odell

[11] 4,029,920

[45] June 14, 1977

[54] FLOAT TYPE ELECTRIC CIRCUIT BREAKER FOR SWIMMING POOLS

[76] Inventor: Donald W. Odell, 8301 Hidden Valley Circle, Fair Oaks, Calif. 95628

[22] Filed: Jan. 29, 1976

[21] Appl. No.: 653,515

[52] U.S. Cl. ..... 200/84 B; 340/244 A

[51] Int. Cl.[2] ..... H01H 35/18

[58] Field of Search ..... 200/84 R, 84 C, 84 B; 340/244 A

[56] References Cited

UNITED STATES PATENTS

| | | | |
|---|---|---|---|
| 2,794,880 | 6/1957 | Carothers | 200/84 B |
| 2,810,036 | 10/1957 | Mejean | 200/84 R |
| 3,849,771 | 11/1974 | Applin | 200/84 C |

*Primary Examiner*—David Smith, Jr.
*Attorney, Agent, or Firm*—Blair & Brown

[57] ABSTRACT

A float type circuit breaker for controlling a valve in a pool which includes a housing having an inlet which permits entry and exit of water as the height of the water changes in the swimming pool. A porous baffle prevents surges of water from entering the pool. A pivoted float within the chamber has a mercury switch mounted therein and arranged to complete the circuit to actuate the swimming pool valve when the water has drained from the chamber permitting the float to pivot downwardly therein. A skirt is provided on the housing to permit a motor driven pool sweep to pass thereover.

5 Claims, 5 Drawing Figures

FLOAT TYPE ELECTRIC CIRCUIT BREAKER FOR SWIMMING POOLS

BACKGROUND OF THE INVENTION

1. Field of the Invention

The present invention relates to a float type electric circuit breaker for controlling the valve of a swimming pool.

2. Summary of the Invention

The present invention includes a housing adapted to be secured to the upper edge or inside the skimmer recess of a swimming pool and having a porous baffle controlling the surge flow of water into and out of a hollow chamber in the housing. A float within the hollow chamber is pivoted and has a mercury switch mounted therein which will be actuated as the float lowers upon the lowering of the water level in the swimming pool. An elongate depending skirt on the housing provides traction for a pool sweep adapted to move about the pool at the upper level thereof.

The primary object of the invention is to provide a float controlled switch which is protected from surge fluctuations due to splashing of the water.

Other objects and advantages will become apparent in the following specification when considered in light of the attached drawings.

DESCRIPTION OF THE PREFERRED EMBODIMENT

Figure 1:
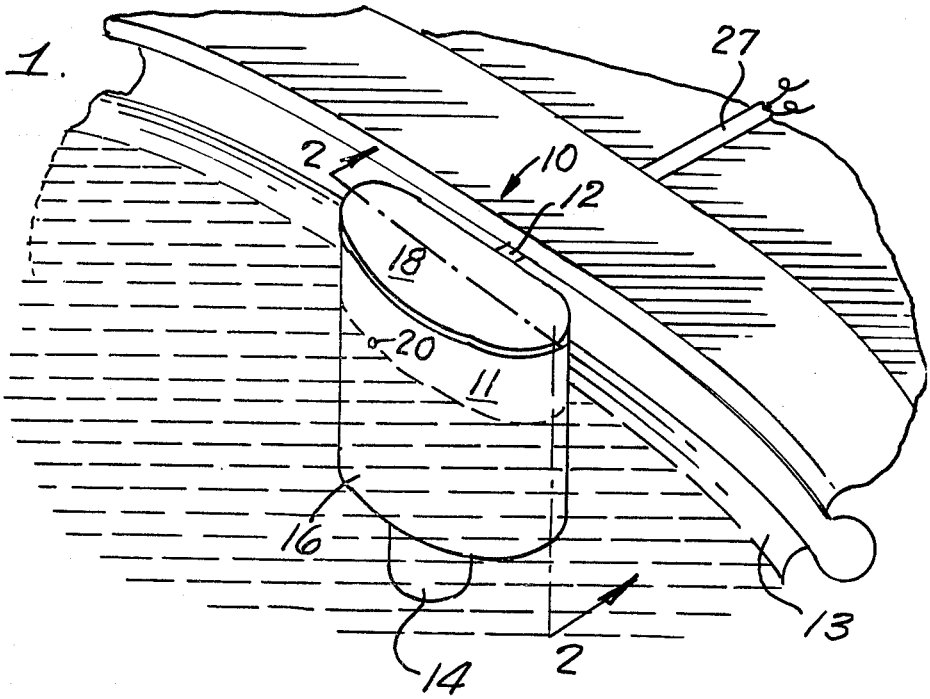
FIG. 1 is a perspective view of the invention shown in position on the edge of a swimming pool.
Figure 2:
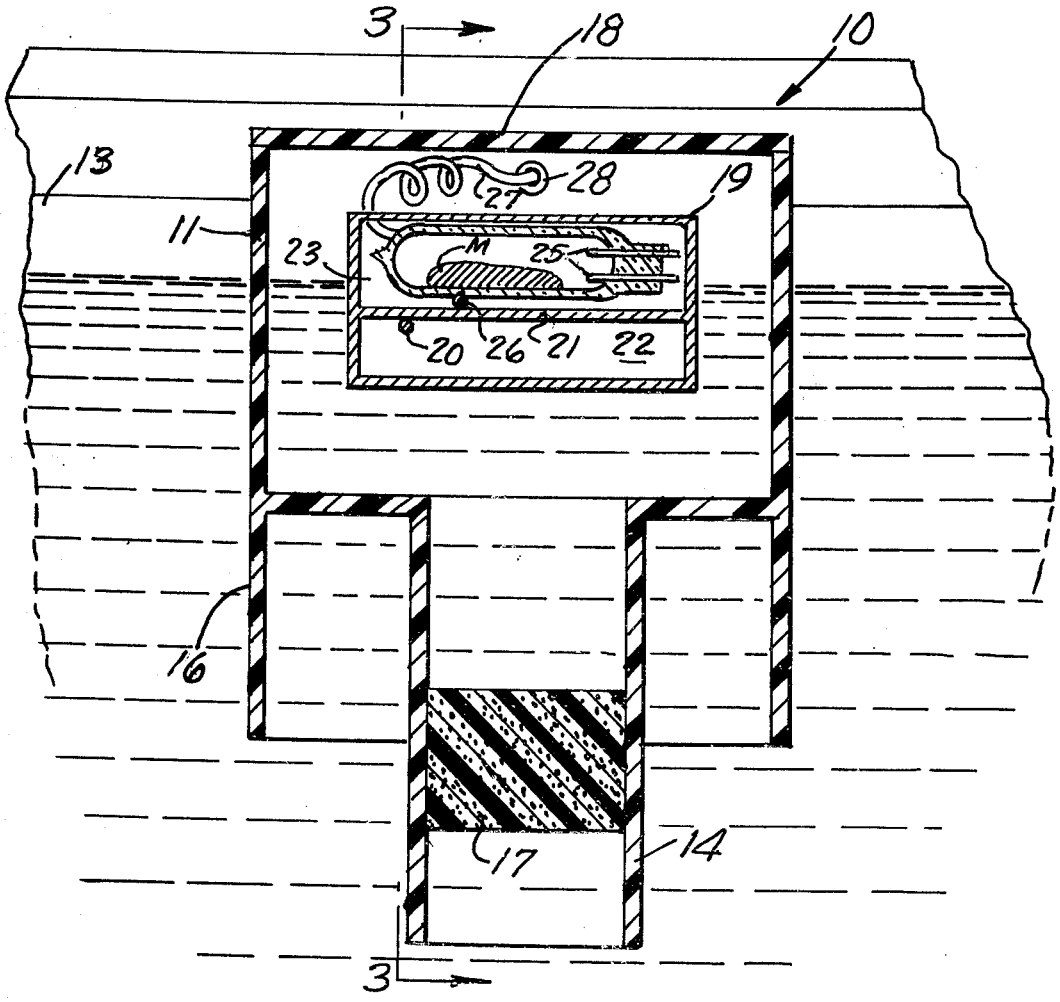
FIG. 2 is an enlarged fragmentary vertical sectional view taken along the line 2—2 of FIG. 1 looking in the direction of the arrows.
Figure 3:
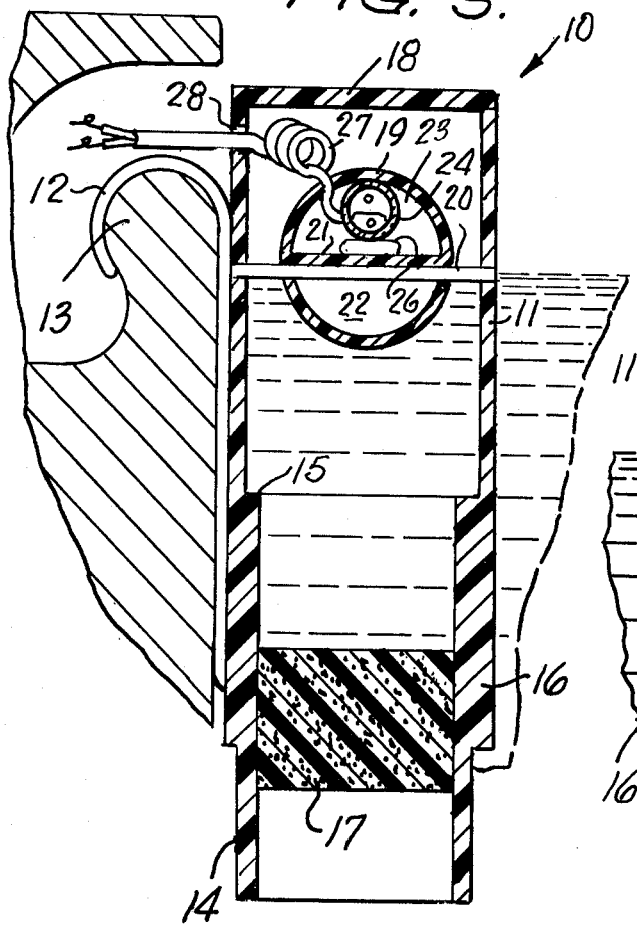
FIG. 3 is a transverse sectional view taken along the line 3—3 of FIG. 2 looking in the direction of the arrows.
Figure 4:
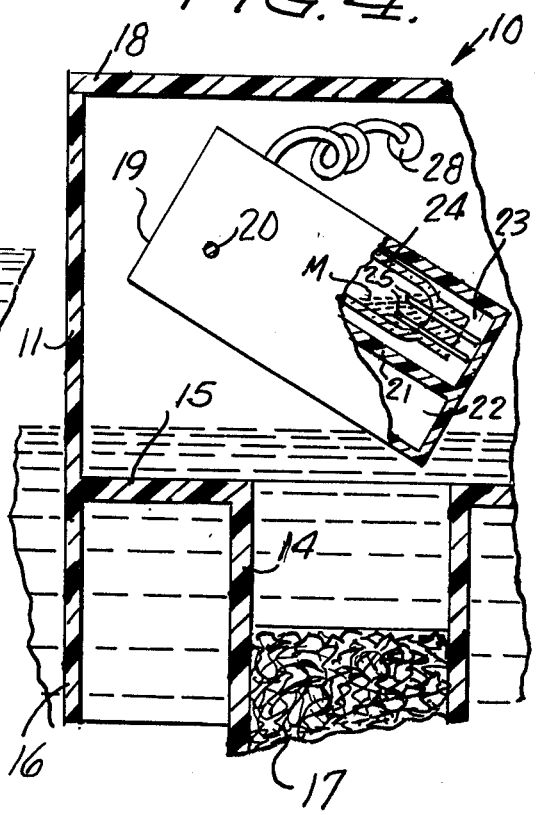
FIG. 4 is a fragmentary view similar to FIG. 2 illustrating the float in its lowered position with the contacts of the mercury switch connected by the mercury.
Figure 5:
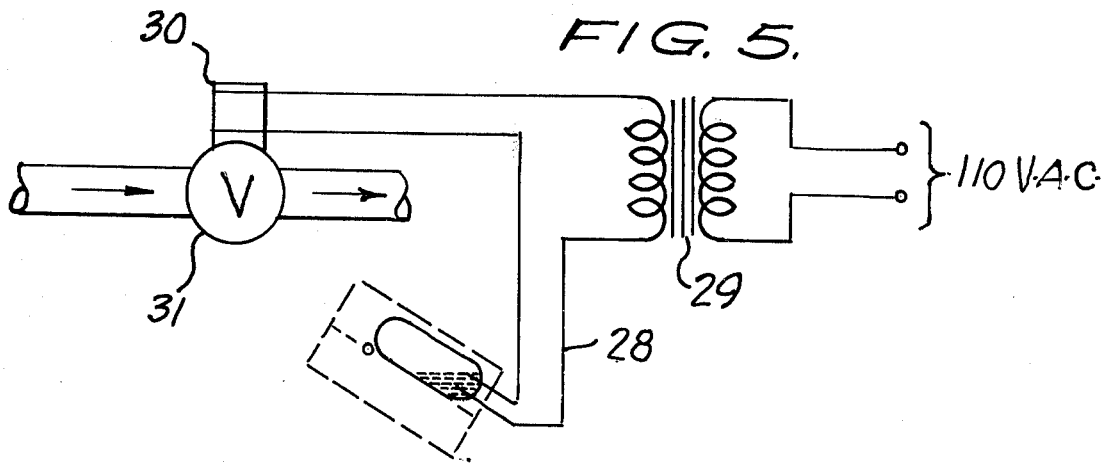
FIG. 5 is a circuit diagram of the electric circuitry of the invention.

Referring now to the drawings in detail wherein like reference characters indicate like parts throughout the several figures the reference numeral 10 indicates generally a water level control for swimming pools constructed in accordance with the invention.

The water level control pin includes a hollow housing 11 having a hook 12 secured thereto for engagement over an edge 13 or inside the skimmer recess of a swimming pool. The housing 11 is upright and has a cylindrical tube 14 depending from a generally horizontal bottom wall 15 thereof. A skirt 16 is formed integrally with the housing 11 and depends therefrom to provide a support for a traction mechanism of a motor driven swimming pool sweep (not shown) which is adapted to move about the upper edge of the swimming pool for cleaning surface debris therefrom.

A porous baffle 17 formed of polyfoam plastic material is positioned in the depending cylindrical tube 14 to permit a flow of water through the tube 14 into the housing 11 but preventing rapid flow of water therethrough due to splashing and surging in the pool.

A cover 18 is secured to the top of the housing 11 to prevent water from being splashed into the housing 11. A generally cylindrical float 19 is positioned within the housing 11 and mounted on a pivot pin 20 which extends through the float 19 and into the housing 11. The float 19 has a generally horizontal wall 21 extending longitudinally thereof and establishing an air-tight chamber 22 therebelow. The wall 21 also provides a switch chamber 23 thereabove and a conventional mercury switch 24 having contacts 25 therein is mounted in the switch chamber 23 on a roller 26. Electric wires 27 extend from the mercury switch 24 through an opening 28 in the housing 11 and extend to a transformer 29 connected to a low voltage coil 30 on a swimming pool control valve 31.

In the use and operation of the invention the housing 11 is mounted in a swimming pool so that the float 19 is generally horizontal when the desired level of water is reached in the swimming pool. As the water falls in the swimming pool it will drain through the porous baffle 17 and permit the float 19 to pivot about the pivot pin 20 to thus permit the mercury M in the mercury switch 24 to bridge the contacts 25 and complete a circuit therethrough to open the valve 31 and to permit a flow of additional water into the swimming pool. As the height of the water increases in the swimming pool it will flow through the porous baffle 17 into the housing 11 raising the float 19 until the mercury M moves out of engagement with the contacts 25 breaking the circuit to the valve 31 and permitting the valve 31 to close to stop further flow of water into the pool.

Having thus described the preferred embodiment of the invention it should be understood that numerous structural modifications and adaptations may be resorted to without departing from the spirit of the invention.

What is claimed is:

1. A float type electric circuit breaker for swimming pools comprising a housing, means securing said housing to the upper edge or skimmer recess of a swimming pool, a float mounted in said housing for pivotal movement about a horizontal pivot extending through said housing and said float, a mercury switch mounted on a roller in said float and electrically connected to a swimming pool control valve, a tube depending from said housing and communicating therewith for permitting a flow of water into and out of said housing, and means in said tube for preventing surge flow of water therethrough, whereby water inflow and outflow in the housing is buffered for the purpose of monitoring only static water level.

2. A device as claimed in claim 1 wherein the means in said tube comprises a polyfoam porous baffle mounted in said tube.

3. A device as claimed in claim 1 including a skirt depending from said housing for supporting a pool sweep.

4. A device as claimed in claim 1 wherein a cover is provided on said housing for preventing splashing of water therein.

5. A device as claimed in claim 1 including a hook rigidly secured to said housing for engaging the top wall edge or skimmer recess of a swimming pool to support the housing therefrom.

* * * * *